US009067115B2

(12) United States Patent
Fu et al.

(10) Patent No.: US 9,067,115 B2
(45) Date of Patent: Jun. 30, 2015

(54) PUNCHING ELASTICITY ADJUSTMENT STRUCTURE

(75) Inventors: Ton-Ki Fu, Taipei (TW); Tung-Chien Fu, New Taipei (TW)

(73) Assignee: Tung-Chien Fu, New Taipei (TW)

( * ) Notice: Subject to any disclaimer, the term of this patent is extended or adjusted under 35 U.S.C. 154(b) by 685 days.

(21) Appl. No.: 13/282,695

(22) Filed: Oct. 27, 2011

(65) Prior Publication Data

US 2013/0109541 A1 May 2, 2013

(51) Int. Cl.

| | |
|---|---|
| ***A63B 69/22*** | (2006.01) |
| ***A63B 69/34*** | (2006.01) |
| ***A63B 69/20*** | (2006.01) |
| ***A63B 21/00*** | (2006.01) |
| ***A63B 21/008*** | (2006.01) |
| *A63B 69/24* | (2006.01) |

(52) U.S. Cl.

CPC ..... *A63B 69/208* (2013.01); *A63B 69/24* (2013.01); *A63B 2225/62* (2013.01); *A63B 21/00069* (2013.01); *A63B 21/0085* (2013.01)

(58) Field of Classification Search

CPC ..... A63B 2071/026; A63B 69/24; A63B 2244/102; A63B 2071/0063; A63B 21/00069; A63B 2225/62; A63B 2071/009; A63B 21/045; A63B 69/208

USPC ..... 482/83–90; 473/441–445

See application file for complete search history.

(56) References Cited

U.S. PATENT DOCUMENTS

| | | | | |
|---|---|---|---|---|
| 6,390,958 | B1 * | 5/2002 | Chu | 482/90 |
| 6,464,621 | B1 * | 10/2002 | Chen | 482/83 |
| 7,651,447 | B2 * | 1/2010 | Yang | 482/85 |
| 7,678,029 | B2 * | 3/2010 | Ng | 482/90 |
| 7,704,194 | B1 * | 4/2010 | Chen | 482/87 |
| 7,998,035 | B2 * | 8/2011 | Chen | 482/83 |
| 8,641,583 | B2 * | 2/2014 | Chen | 482/83 |
| 2008/0125293 | A1 * | 5/2008 | Ng | 482/84 |
| 2011/0251024 | A1 * | 10/2011 | Hu | 482/90 |

* cited by examiner

*Primary Examiner* — Loan H Thanh
*Assistant Examiner* — Andrew S Lo
(74) *Attorney, Agent, or Firm* — Raymond Y. Chan; David and Raymond Patent Firm

(57) ABSTRACT

The present invention relates to a punching elasticity adjustment structure which comprises one punching bag connecting set, one elastic bladder, one air valve, one base, and one elastomer. The said elastic bladder is inflated via said air valve to increase the inner pressure so the said elastic bladder expands vertically with rised height, resulting in bigger gap between said punching hag connecting set and said base and simultaneously elongates said elastomer and changes its elasticity. Elasticity therefore can be adjusted to meet the demand of diversified training effects.

2 Claims, 14 Drawing Sheets

PUNCHING ELASTICITY ADJUSTMENT STRUCTURE

BACKGROUND OF THE INVENTION

1. Field of the Invention

The present invention relates to a punching elasticity adjustment structure; particularly one that using elastomer driven by degree of air bladder inflation to adjust punching training devices.

2. Description of Prior Arts

Principle of conventional martial training device is: one punching bag (such as speed bag or filler bag), when punched by external force, will swing back and forth or absorb the impact utilizing elasticity of elastomer connecting to said punching bag.

Elastic coefficients of elastomer of most said martial training devices are fixed so elastic strength and flexibility cannot be adjusted upon different needs, resulting in insufficient combat training. There are a small number of existing training devices which are elasticity-adjustable. However, they are either done by rigid structures adjusted by stretching spiral sleeves or screws, which may result in dangers when there is breakage due to excess impact or users may be injured by direct hit on the structure; or it may be done by mere air inflation of elastic bladder, resulting in insufficient elasticity to meet demanded strength for training.

Thus, there are foregoing drawbacks of conventional elastic structure of punching training device in prior art to be improved.

SUMMARY OF THE INVENTION

To improve drawbacks of prior invention, the present invention provides a punching elasticity adjustment structure that allows elasticity of training device to be adjusted according to different needs, meets specific requirements of combat exercise, and whose overall structure with sufficient strength to withstand impact and resolve rotation torque.

The present invention discloses a punching elasticity adjustment structure which comprises one elasticity adjustment set; wherein the said elasticity adjustment set further comprises one punching bag connecting set, one elastic bladder, one air valve, one base, and one elastomer.

There is one through-hole in the middle of said punching bag connecting set, and the said connecting set further comprises one cylinder first junction. One end of said first junction is inserted through said through-hole and stops at bottom of said punching bag connecting set, and the other end connects to junction section of one punching bag. Said elastic bladder is one vertically extendable bladder structure with its top connecting to bottom part of said punching bag connecting set. Said air valve connects to interior of said elastic bladder to inflate or deflate said elastic bladder in order to change height of said elastic bladder. The top of said base connects to bottom of said elastic bladder; and said base has a junction section on the lower part to fix to top of one base seat. Said elastomer is elastically adjustable, placed on the side of said elastic bladder and retained between said punching bag connecting set and said base. Elasticity of said elastomer is adjusted by changing height of said elastic bladder. Said elastomer is one elastic pillar or multiple elastic tapes.

When said elastomer is one elastic pillar, said elastic pillar is inserted through the hollow tube in the center of said elastic bladder. Said elastic pillar further comprises one second junction, one first rod, one second rod, and one elastic section; said second junction is a cylinder with one end inserted through and retains on bottom of said base; said first rod is a cylinder with one end connecting to one end of said first junction; said second rod is a cylinder with one end connecting to the other end of said second junction; said elastic section is elastomer with one end fixed to the other end of first rod and the other end fixed to the other end of said second rod.

Said elastic pillar further comprises one first fixation set and one second fixation set; one end of said first fixation set is fixed to one end of said elastic section and the other end connects to the other end of said first rod; one end of said second fixation set is fixed to the other end of said elastic section and the other end connects to the other end of said second rod.

When said elastomer is elastic tapes, lower part of said elastic tape can be fixed to said base; or when said elastomer is elastic tapes, said elasticity adjustment set further comprises one lodge cover, multiple fixing holes in base, and multiple fixers; said lodge cover covers bottom of said base and has multiple fixed through-holes to the bottom of said lodge cover; fixing holes in said base are located on bottom of said base and correspond to positions of fixed through-holes of said lodge cover; said fixers fix through-holes of said lodge cover to fixing holes in said base. Top of said elastic tapes cover or is fixed to top of said punching bag connecting set, or top of said elastic tapes integrated with said punching bag connecting set; with the case said elastic tape integrated with said punching hag connecting set, only elastic tapes on the sides have elasticity. Bottom of said elastic tapes is inserted and installed between said lodge cover and said base. Said elastic tapes further comprise one through-hole and multiple anchors; said through-hole is located on central top of said elastic tapes and inserted through by the other end of said first junction. Said anchors locate on bottom of said elastic tapes and are wedged between said lodge cover and said base.

Preferably, there is restriction parts on the side of said elastic bladder and said restriction parts are multiple steel wires or shaping ring structure, or inelastic or vertically extendable fabric structure; said steel wire or shaping ring structure are used to limit width of said elastic bladder and said fabric structure may be materials such as glass fiber fabric or synthetic leather; lengths of said first rod and second rod can be different and interchangeable to place said elastomer upward or downward to produce different swing range of said punching hag.

Other than foregoing composition and effects of punching elasticity adjustment structure of present invention, said punching bag connecting set further comprises multiple breaches and one first junction. Said breaches locate on bottom end on the side of said punching bag connecting set; said first junction locates on top side of said punching bag connecting set and integrates with junction section of one punching bag. Said elastomer is the multiple elastic tapes located on external side of said elastic bladder with one end insert into breach of said punching bag connecting set and retained on bottom of said punching bag connecting set. Said elasticity adjustment set further comprises multiple block sets which installed on breaches of said punching bag connecting set.

DETAILED DESCRIPTION OF THE PREFERRED EMBODIMENTS

Figure 1:
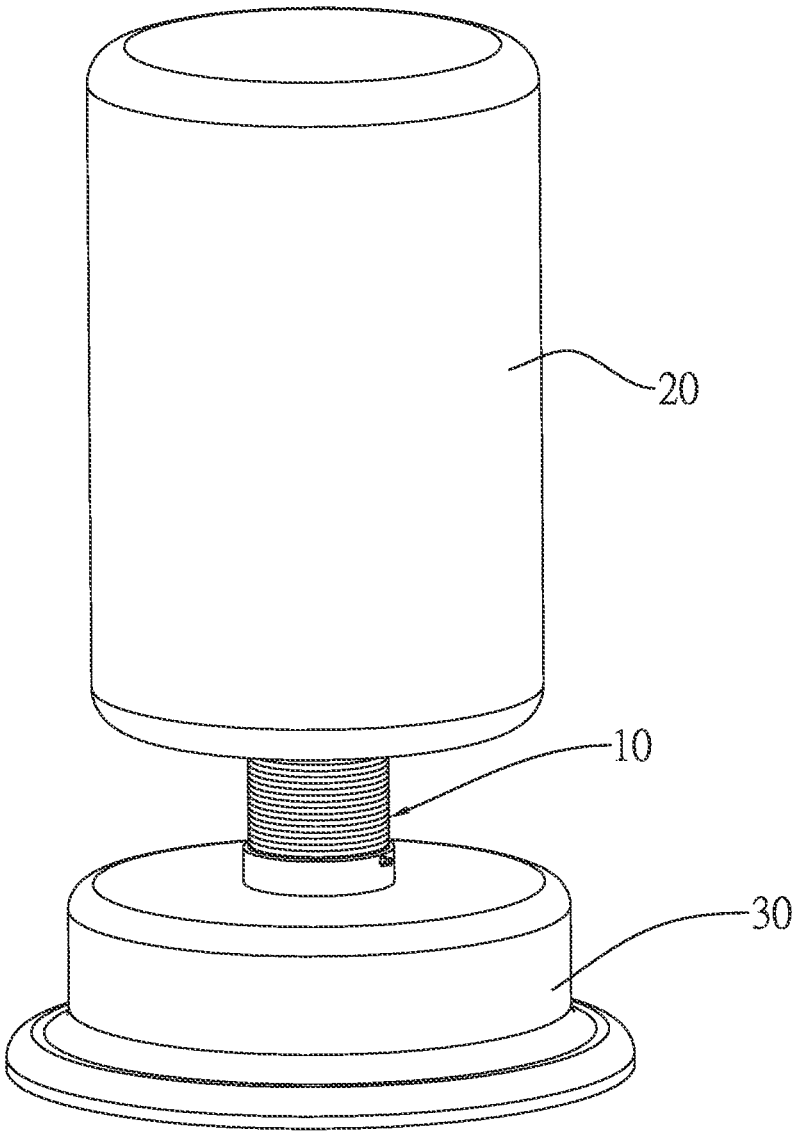
FIG. 1 is a three-dimensional view of embodiment A of present invention.
Figure 2:
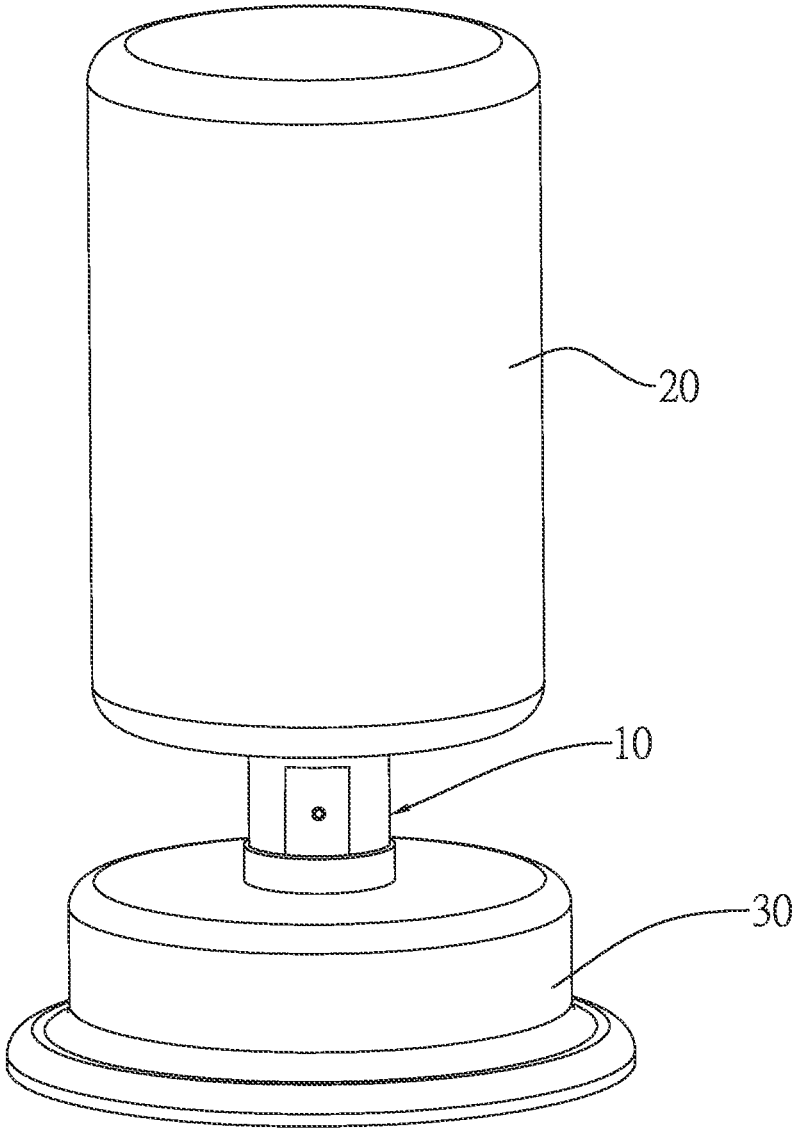
FIG. 2 is a three-dimensional view of embodiment B of present invention.

Please refer to FIGS. 1 and 2 for three-dimensional views of different embodiments of punching elasticity adjustment structure of present invention. Please refer to FIGS. 3, 4, 5, 6, 7, and 11 for sectional views of different embodiments of punching elasticity adjustment structure of present invention. Please refer to FIGS. 8, 9, 10, 12, 13 and 14 for three-dimensional exploded views of different embodiments of punching elasticity adjustment structure of present invention. Wherein said punching elasticity adjustment structure comprises one elasticity adjustment set 10; the top of said elasticity adjustment set 10 is fixed to bottom part of one punching bag 20 and the bottom of said elasticity adjustment set 10 is fixed to top of one base seat 30, as shown in FIGS. 1 and 2.

As shown in FIGS. 8, 9, 10, and 12, said elasticity adjustment set 10 comprises one punching bag connecting set 11, one elastic bladder 13, one air valve 16, one base 14, and one elastomer 12.

Wherein the said punching bag connecting set 11 has one through-hole 111 in the center, and comprises one cylinder first junction 112; said elastic bladder 13 is vertically extendable bladder structure; said base 14 has one junction section 141 in the lower part; said elastomer 12 is one elastic pillar 121 with elasticity or multiple elastic tapes 122. Said elastic pillar 121 locates in the center of elastic bladder 13 and said elastic tapes 122 locate on external side of said elastic bladder 13.

Figure 4:
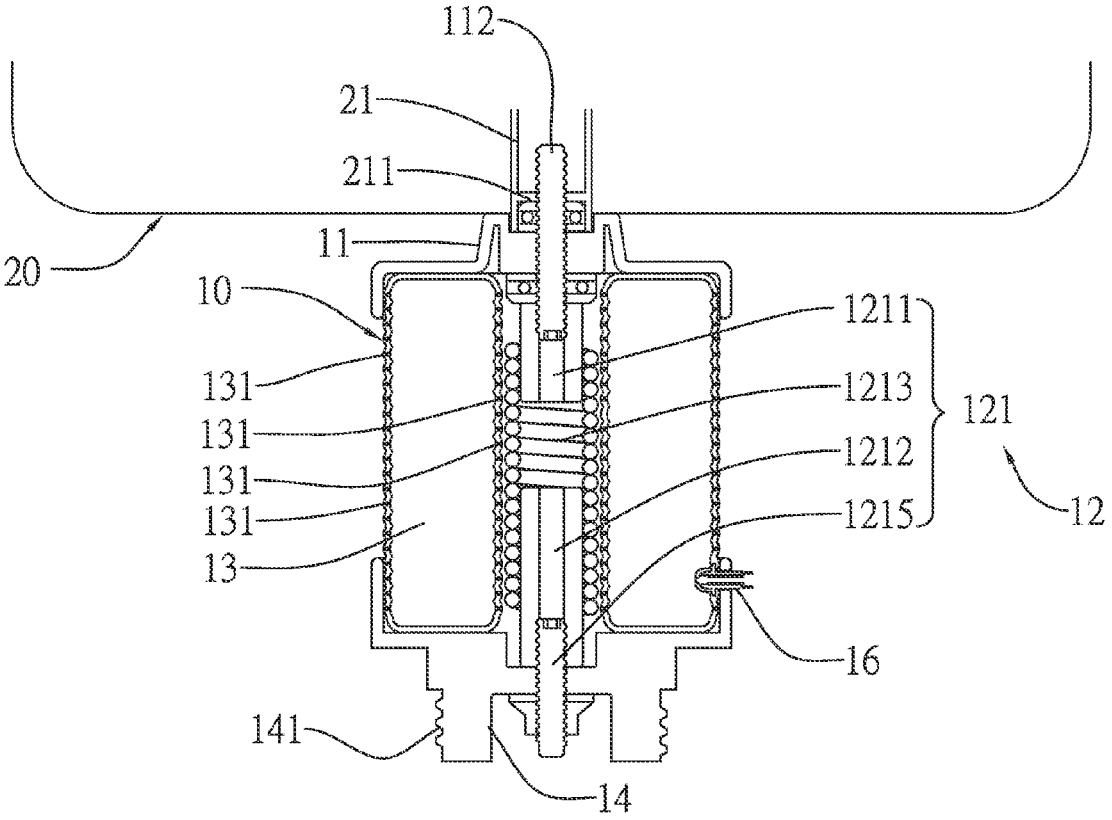
FIG. 4 is a sectional view of embodiment A of present invention.
Figure 5:
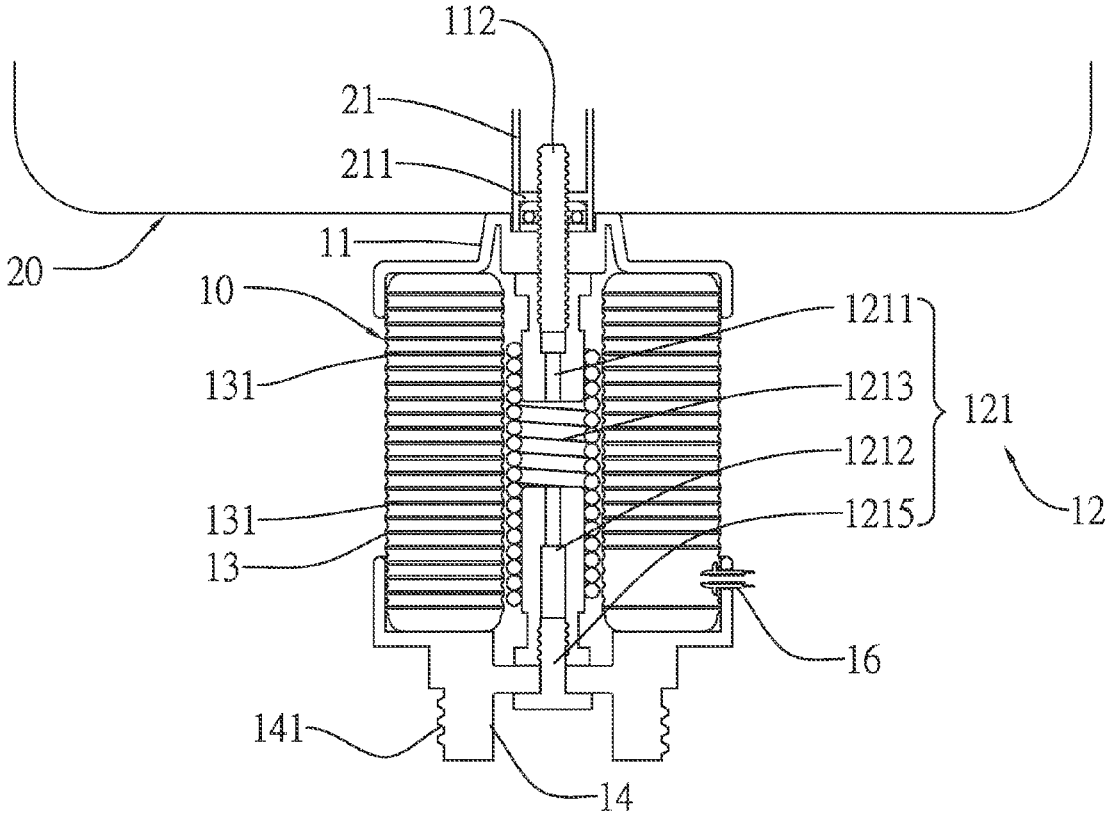
FIG. 5 is another sectional view of embodiment A of present invention.
Figure 6:
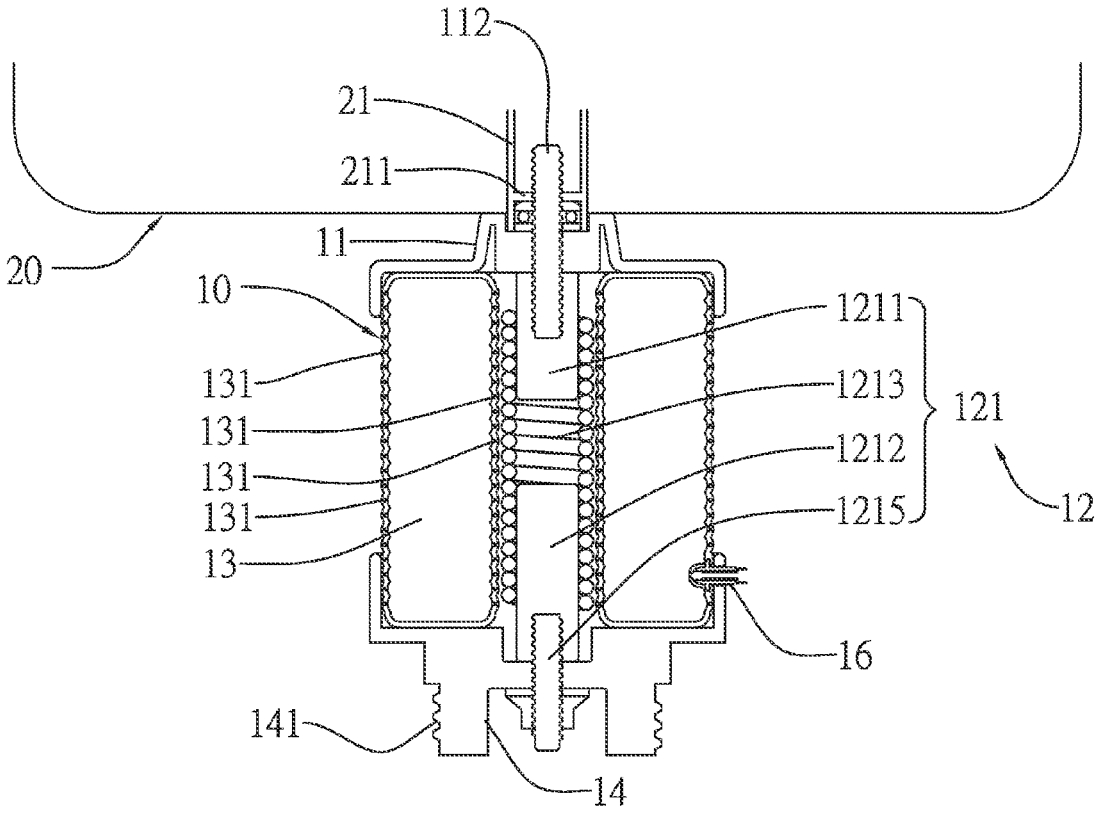
FIG. 6 is another sectional view of embodiment A of present invention.

As shown in FIGS. 4, 5, and 6, there are multiple restriction parts 131 on the sides of said elastic bladder 13, said restriction parts 131 are multiple steel wires or shaping ring structure. Said elastomer is elastic pillar 121 which further comprises one second junction 1215, one first rod 1211, one second rod 1212, and one elastic section 1213. Said second junction 1215, first rod 1211 and second rod 1212 are cylinders and said elastic section 1213 is elastomer.

Said air valve 16 connects to interior of said elastic bladder 13; the top of said elastic bladder 13 connects right under said punching bag connecting set 11; the top of said base 14 connects to bottom of said elastic bladder 13; said elastic pillar 121 is retained between said punching bag connecting set 11 and said base 14.

Firstly, one end of said elastic section 1213 is fixed to one end of said first rod 1211, and the other end is fixed to one end of said second rod 1212; said elastic pillar 121 is inserted through the hollow tube in the center of said elastic bladder 13.

Next, one end of said first junction 112 is inserted through through-hole 111 of said punching bag connecting set 11, and connects to the other end of said first rod 1211. The other end of said first junction 112 connects to junction section 211 of center pole 21 of punching bag 20.

Then, one end of said second junction 1215 in inserted through and retains at bottom of said base 14 while the other end connects to the other end of said second rod 1212; junction section 141 of said base 14 connects to the top of one base seat 30.

Finally, inflate said elastic bladder 13 via said air valve 16 to increase internal pressure of said elastic bladder 13. Said elastic bladder 13 only expands vertically due to existence of said restriction parts 131 which limit elastic bladder 13 for horizontal expansion. Thus, height of said elastic bladder 13 rises and enlarges the gap between said punching bag connecting set 11 and said base 14; elastic section 1213 of said elastic pillar 121 is simultaneously elongated to change elasticity of said elastomer 12.

Figure 7:
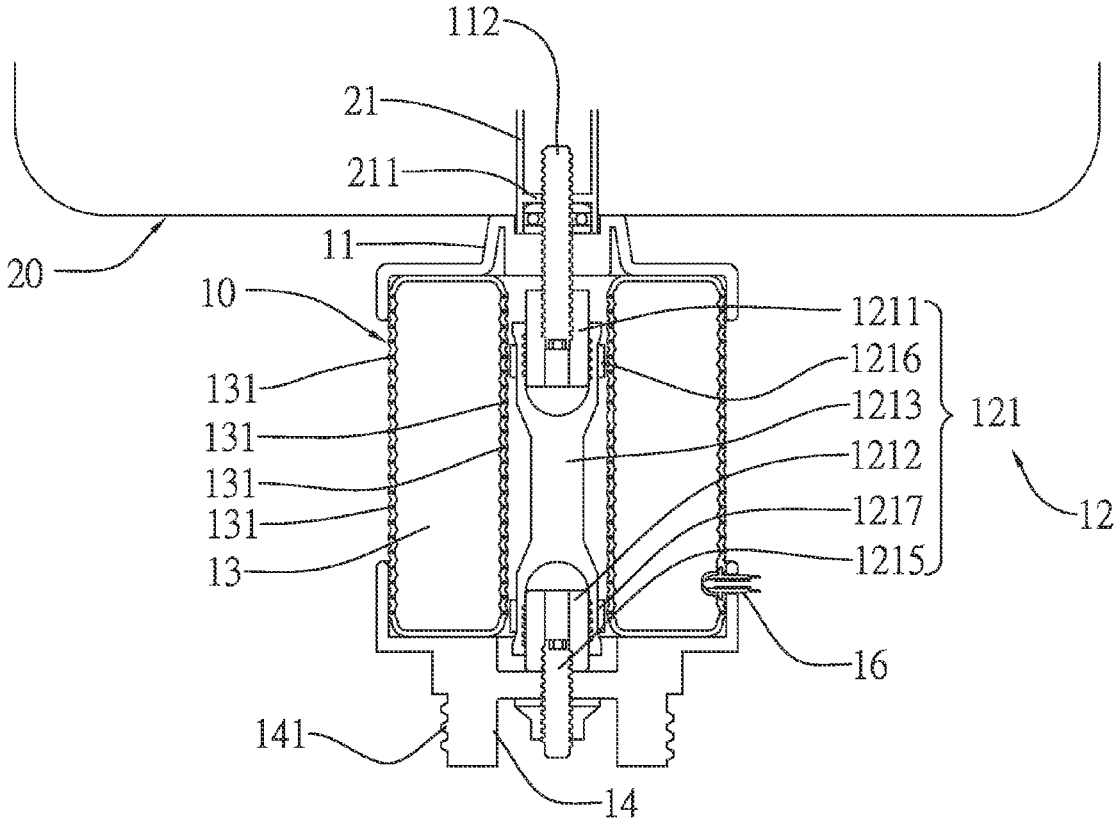
FIG. 7 is another sectional view of embodiment A of present invention.
Figure 8:
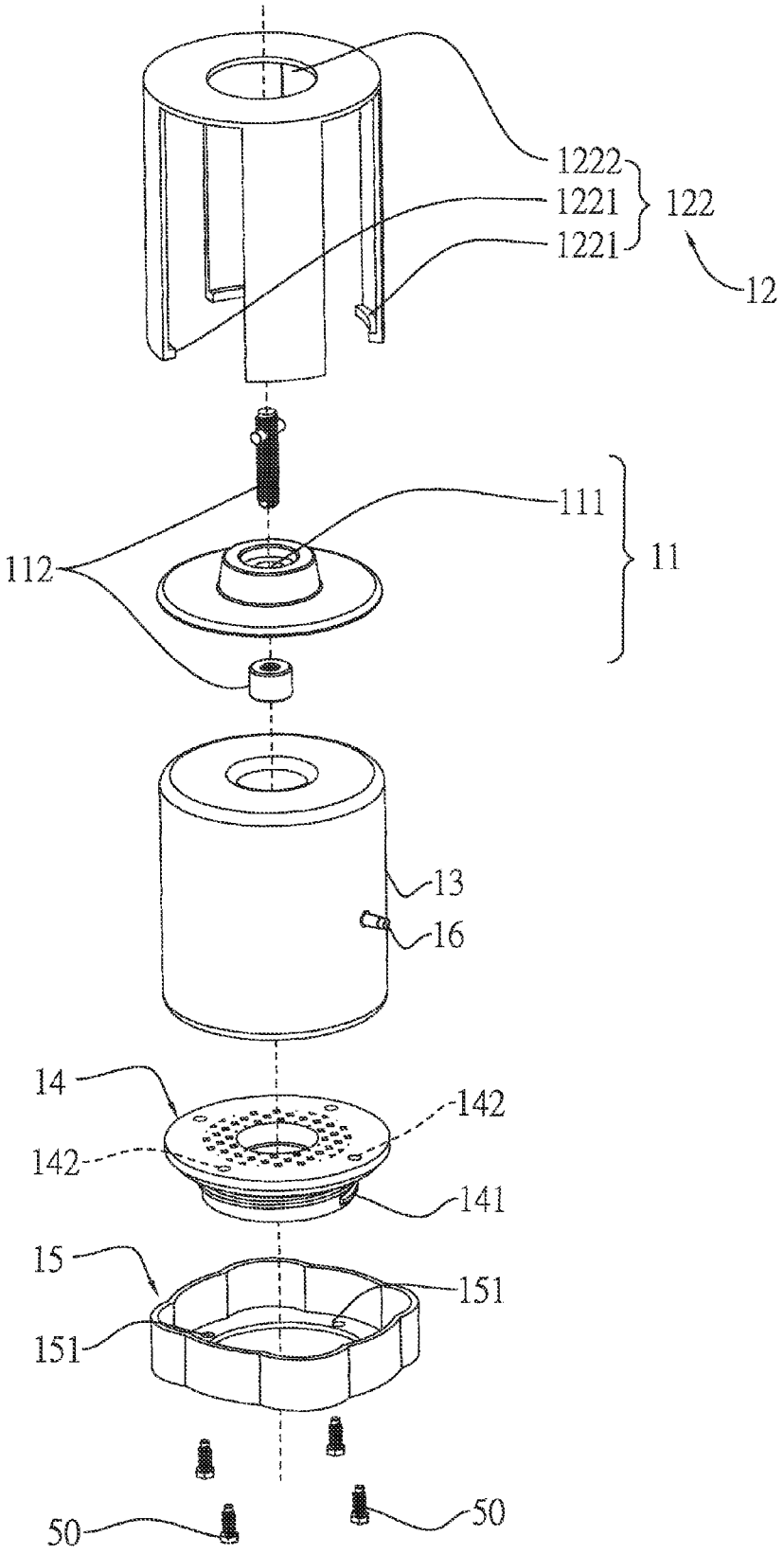
FIG. 8 is a three-dimensional exploded view of embodiment B of present invention.
Figure 9:
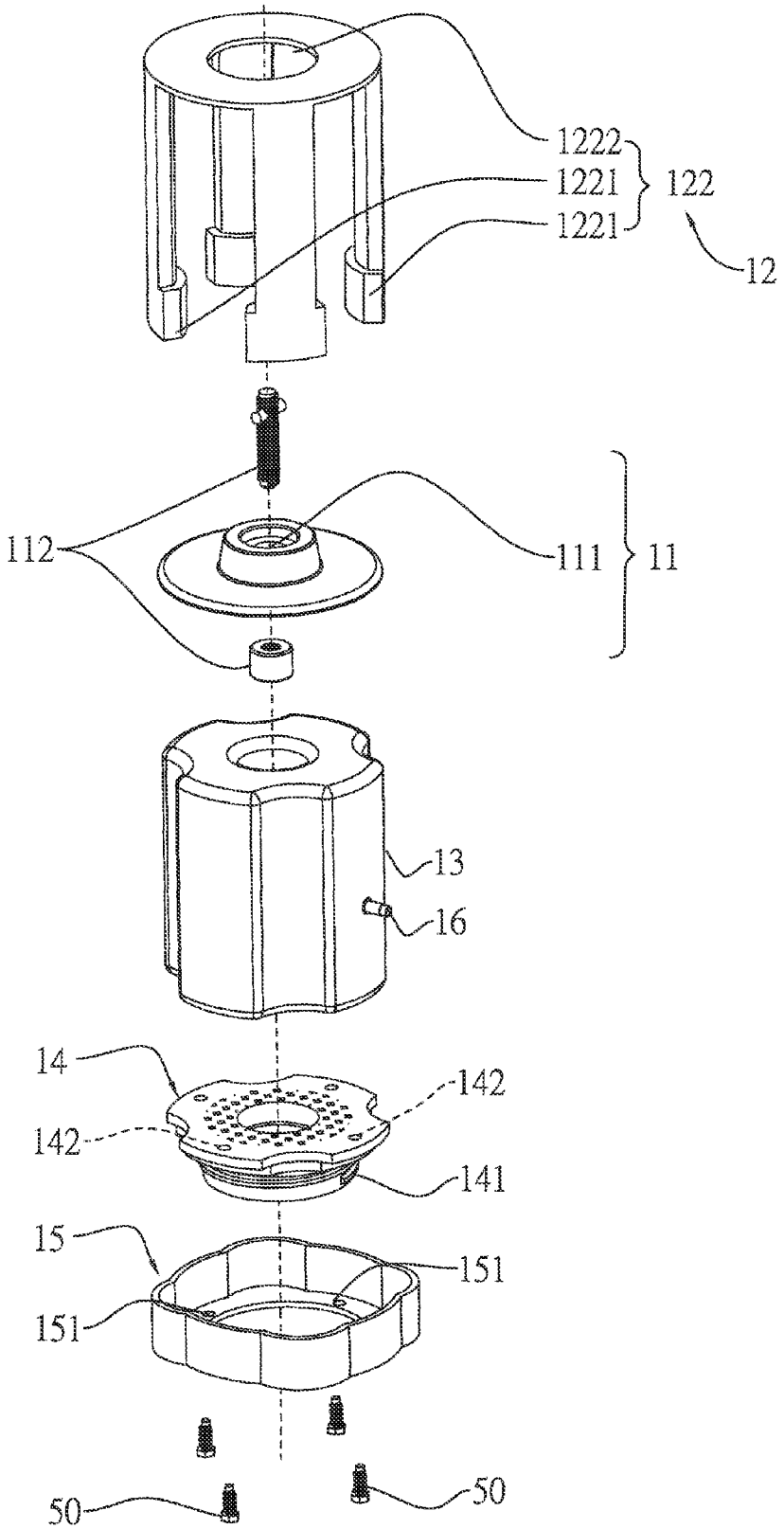
FIG. 9 is another three-dimensional exploded view of embodiment B of present invention.
Figure 10:
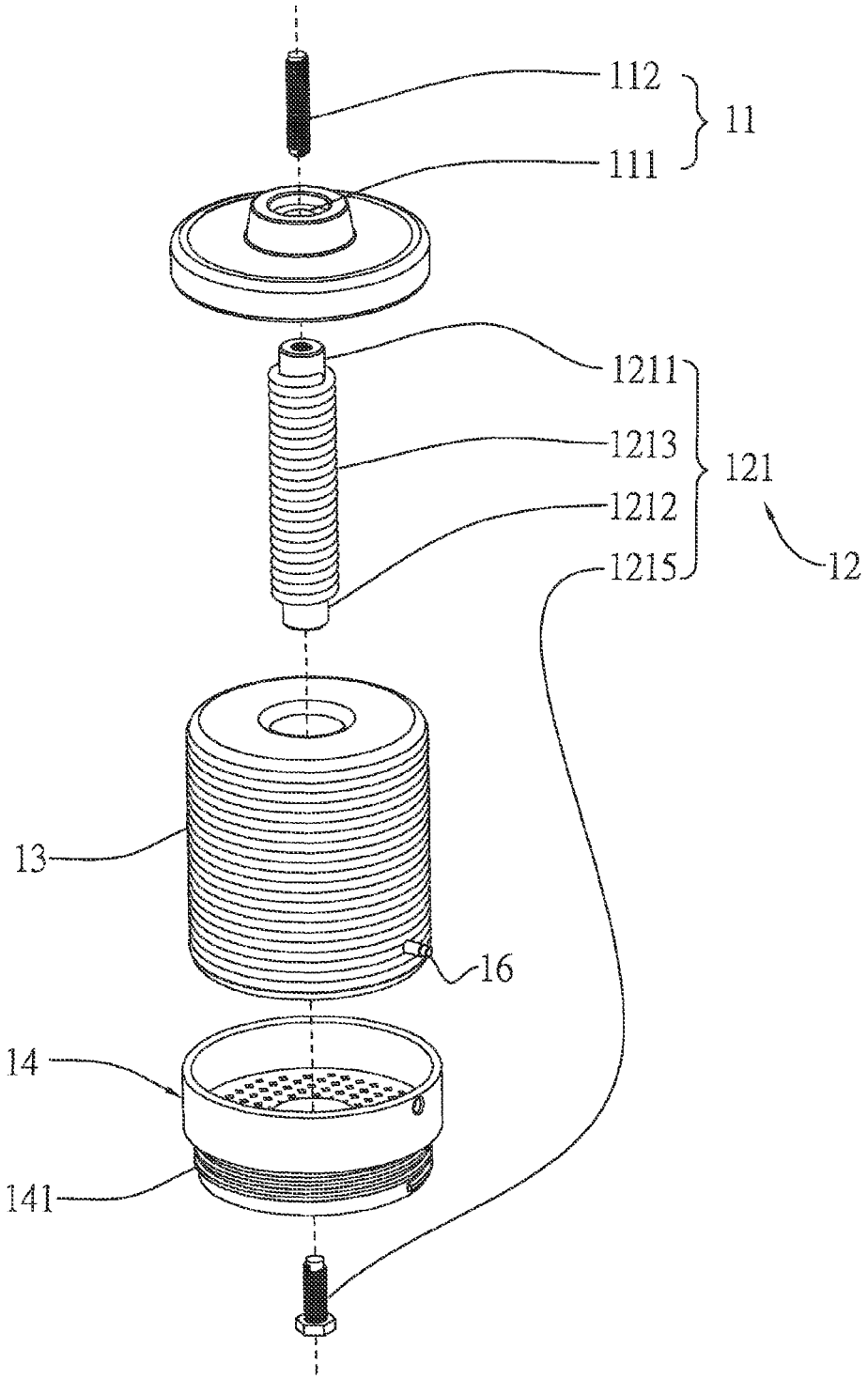
FIG. 10 is a three-dimensional exploded view of embodiment A of present invention.

Structure shown in FIG. 7 is similar to that of FIG. 6, but said elastic pillar 121 further comprises one first fixation set 1216 and one second fixation set 1217; one end of said first fixation set 1216 is fixed to external side of one end of said elastic section 1213, making one end of said elastic section 1213 fixed to one end of said first rod 1211; one end of said second fixation set 1217 is fixed to external side of the other end of said elastic section 1213, making the other end of said elastic section 1213 fixed to one end of said second rod 1212.

Figure 3:
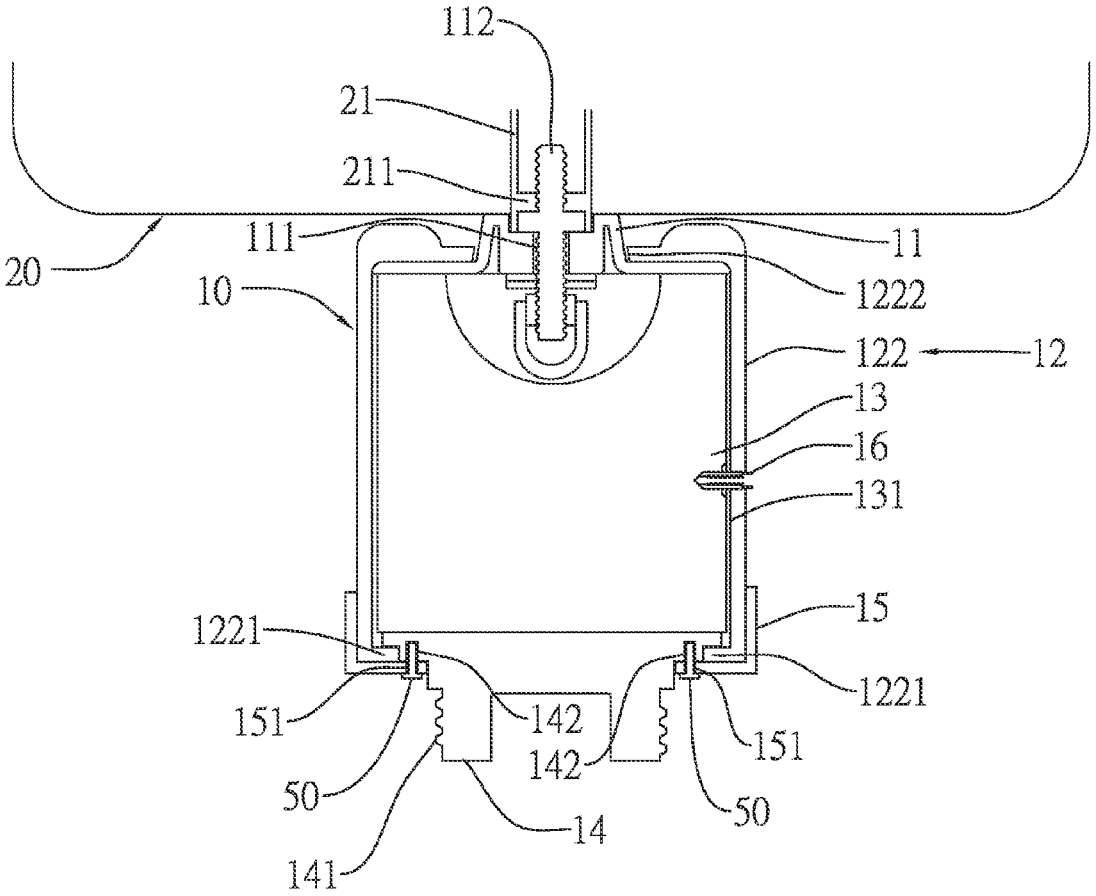
FIG. 3 is a sectional view of embodiment B of present invention.

As shown in FIG. 3, said elastic bladder 13 has a restriction part 131 of either vertically extendable or inelastic fabric structure, on the side; said elastomer 12 is made of multiple elastic tapes 122; and said elasticity adjustment set 10 further comprises one lodge cover 15, multiple fixing holes 142 in base 14, and multiple fixers 50. There are multiple fixed through-holes 151 on the lower part of said lodge cover 15. Fixing holes 142 are located on lower part of said base 14 and correspond to positions of fixed through-holes 151 of lodge cover 15. Said elastic tapes 122 further comprises one through-hole 1222 and multiple junction sections 1221; said through-hole 1222 is located on the central top of said elastic tapes 122 while said anchors 1221 located on lower part of said elastic tapes 122.

Said air valve 16 connects to interior of said elastic bladder 13; the top of said elastic bladder 13 connects right under said punching bag connecting set 11; the top of said base 14 connects to bottom of said elastic bladder 13; said elastic tapes 122 retains between said punching bag connecting set 11 and said base 14 and said fixed through-holes 151 penetrate bottom of said lodge cover 15.

Firstly, top of said elastic tapes 122 covers on top of said punching bag connecting set 11; one end of said first junction 112 is inserted through through-hole 1222 of said elastic tape 12 and through-hole 111 of said punching bag connecting set 11 and then retains at bottom of said punching bag connecting set 11. The other end of said first junction 112 connects to junction section 211 of center pole 21 of one punching bag 20.

Then, place anchors 1221 of said elastic tapes 122 on the external side of said base 14 and place lodge cover 15 on bottom of said base 14, making said anchors 1221 wedged between said lodge cover 15 and said base 14, and then fix through-holes 151 of said lodge cover 15 and fixing holes 142 in said base 14 with said fixer 50. Junction section 141 of said base 14 connects to the top of one base seat 30.

Finally, inflate said elastic bladder 13 via said air valve 16 to increase internal pressure of said elastic bladder 13. Said elastic bladder 13 only expands vertically due to existence of said restriction parts 131 which limit elastic bladder 13 for horizontal expansion. Thus, height of said elastic bladder 13 rises and enlarges the gap between said punching bag connecting set 11 and said base 14; elastic tapes 122 are simultaneously elongated to change elasticity of said elastomer 12.

Figure 13:
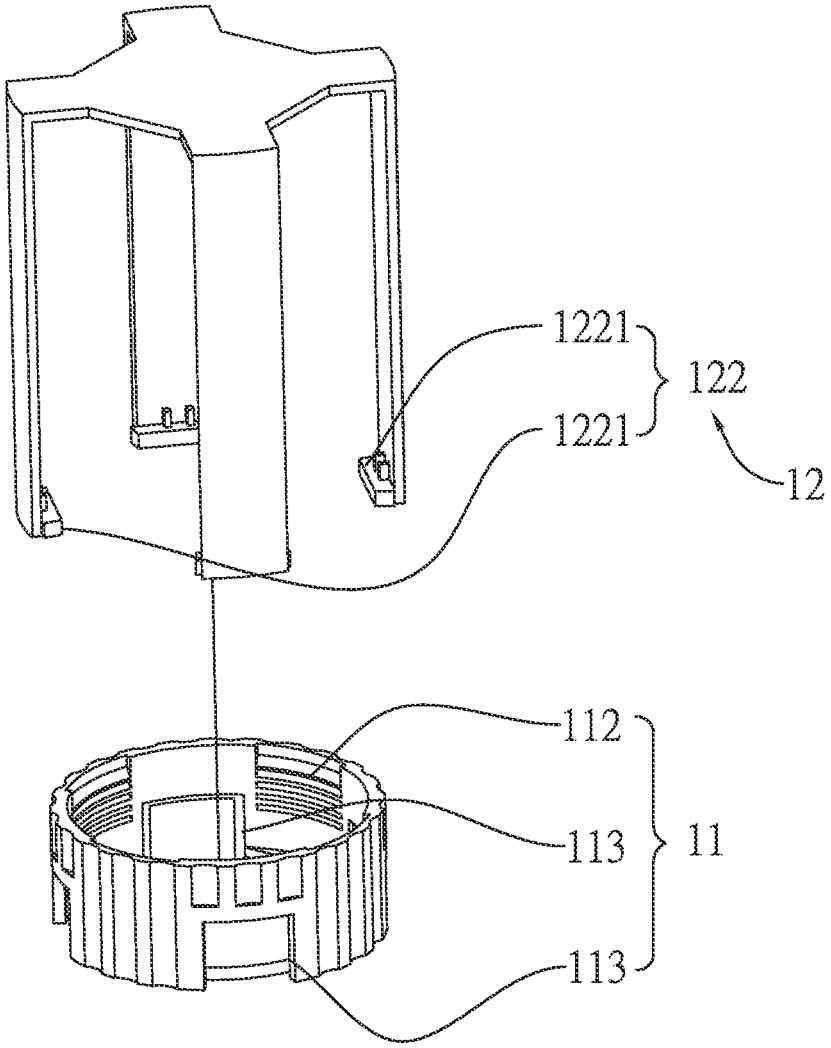
FIG. 13 is a three-dimensional exploded view of one punching bag connecting set and elastic tape of embodiment B of present invention.
Figure 14:
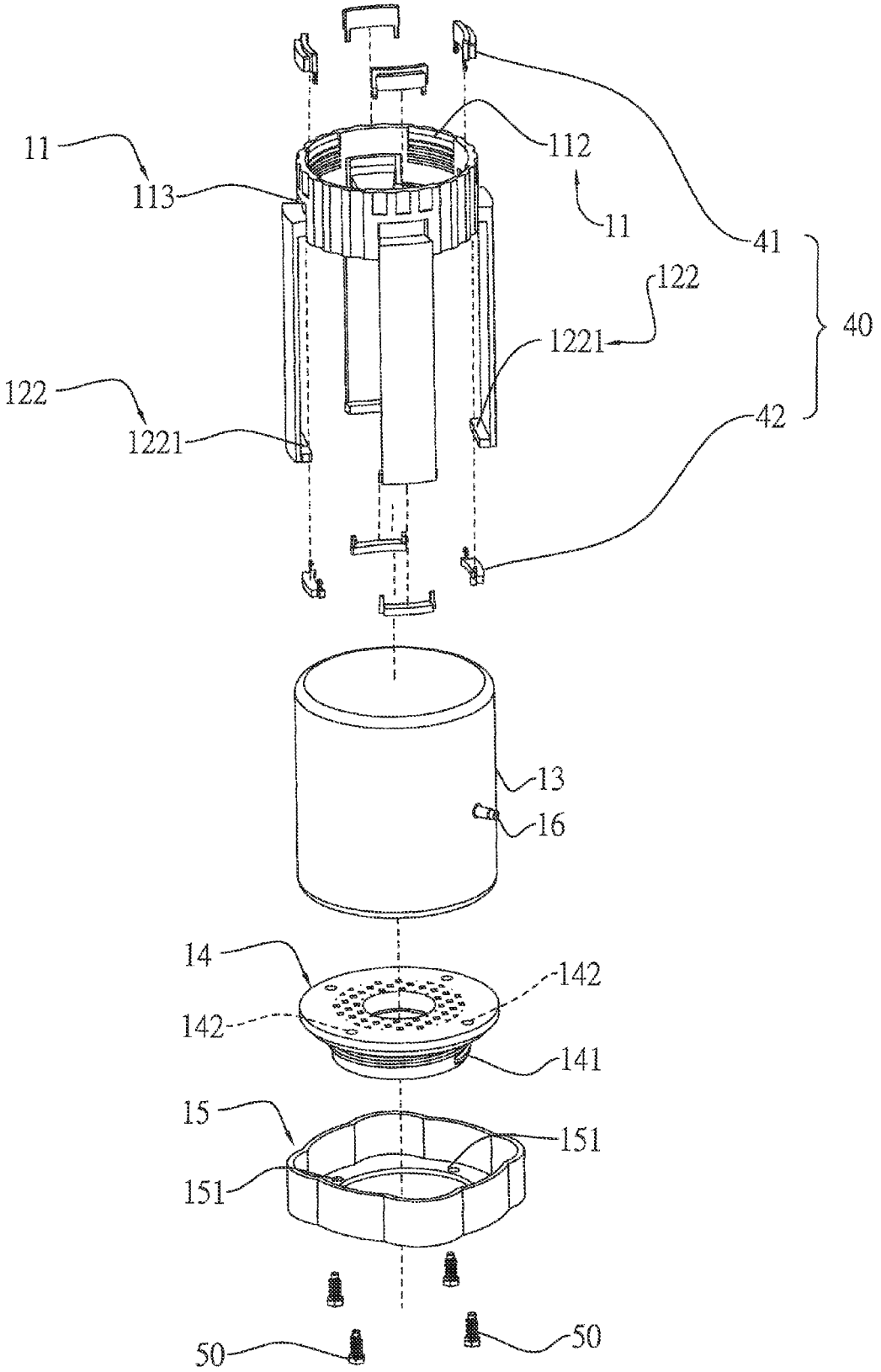
FIG. 14 is another three-dimensional exploded view of embodiment B of present invention.

Said elasticity adjustment set 10 comprises one punching bag connecting set 11, one elastic bladder 13, one air valve 16, one base 14, and one elastomer 12, as shown in FIGS. 13 and 14.

The said punching bag connecting set 11 further comprises multiple breaches 113 and one first junction 112. The said breaches 113 locate on the bottom part on the sides and said first junction 112 locates on top part of said punching bag connecting set 11; said elastic bladder 13 is vertical extendable bladder structure; said base 14 has one junction section 141 in the lower part; said elastomer 12 is multiple elastic tapes 122 with elasticity, locates on external side of said elastic bladder 13. Said elasticity adjustment set 10 comprises multiple block sets 40 which further comprises one first block 41 and one second block 42.

Figure 11:
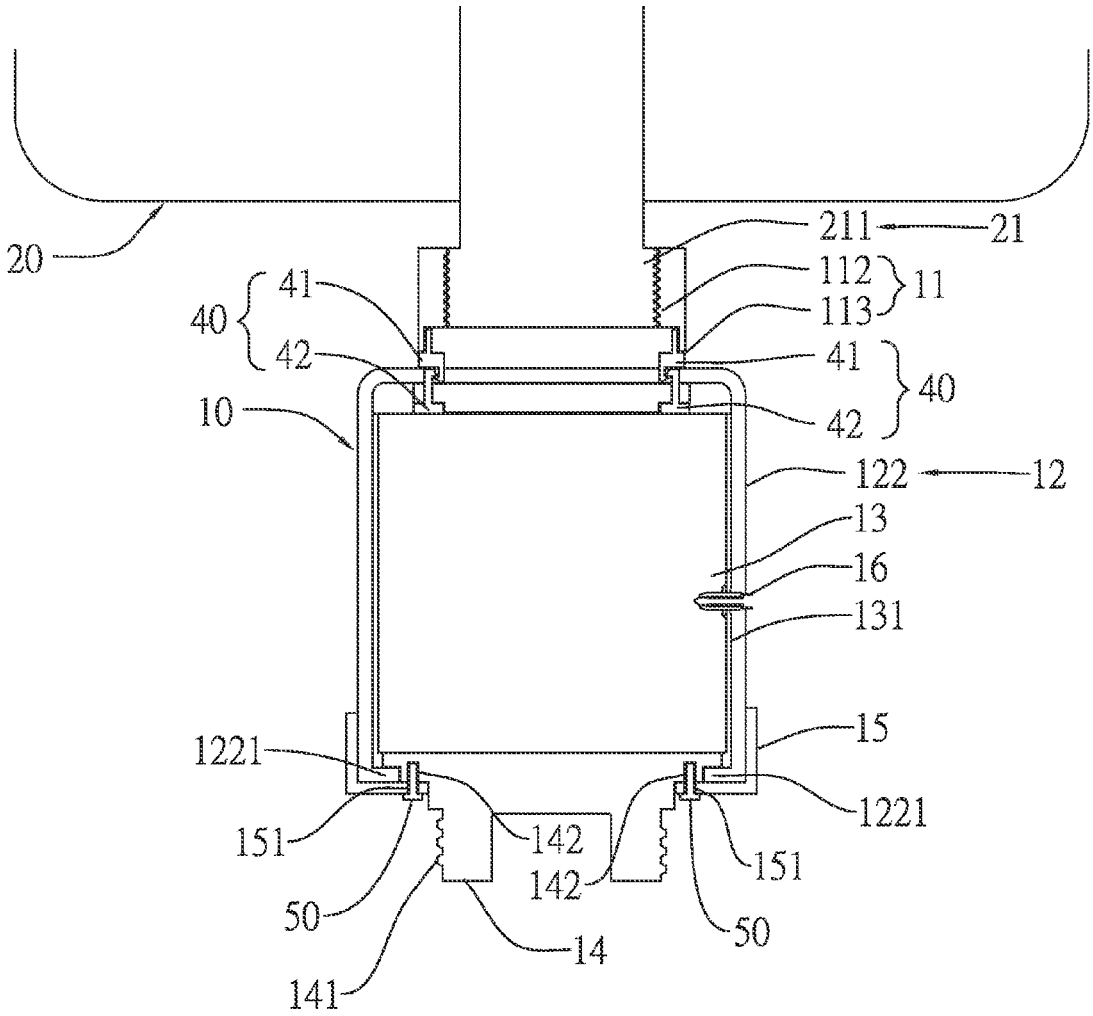
FIG. 11 is another sectional view of embodiment B of present invention.
Figure 12:
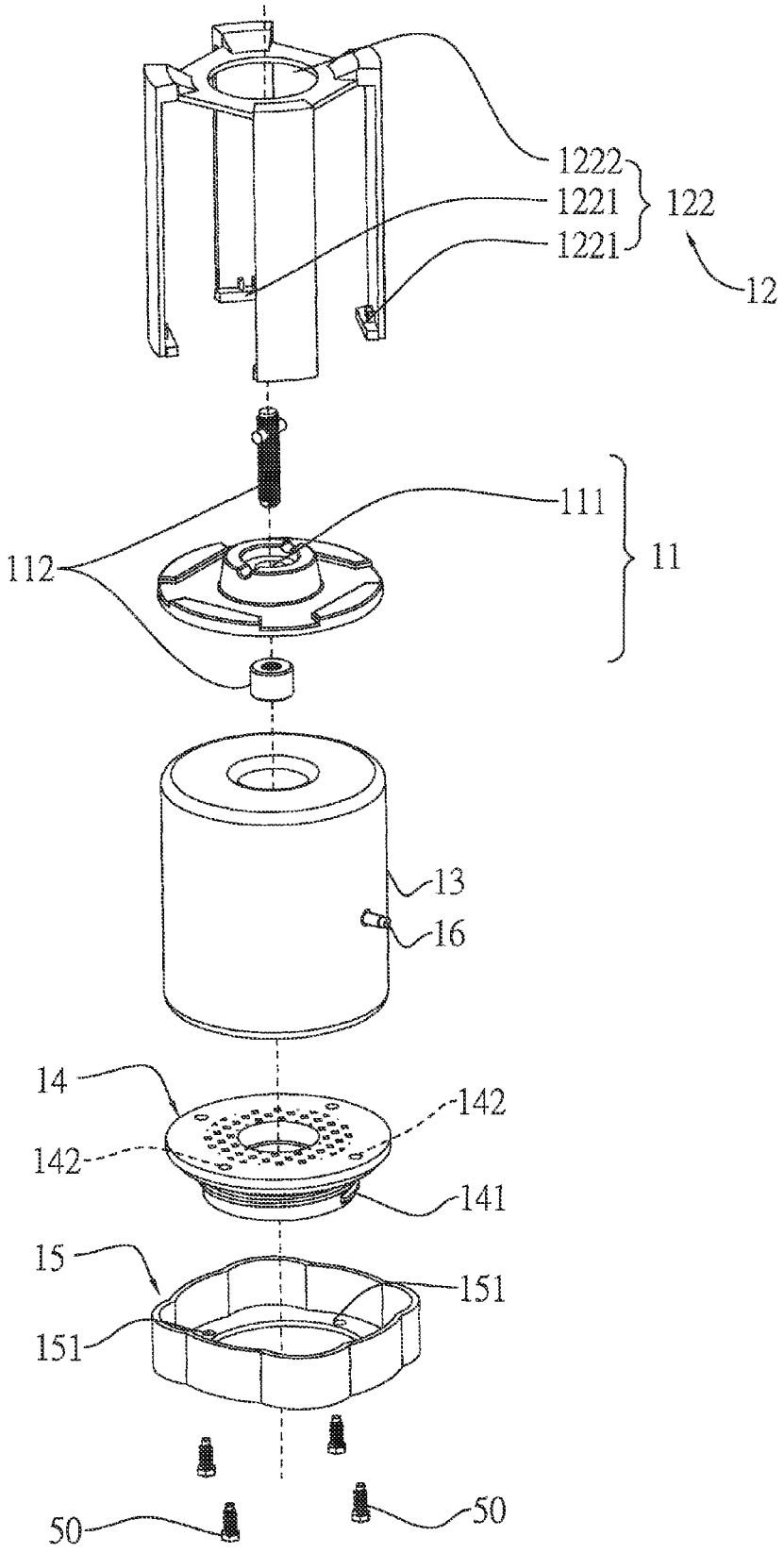
FIG. 12 is another three-dimensional exploded view of embodiment B of present invention.

As shown in FIG. 11, said elastic bladder 13 has multiple restriction parts 131 of either vertically extendable or inelastic fabric structure, on the side; said elastomer 12 is made of multiple elastic tapes 122; and said elasticity adjustment set 10 further comprises one lodge cover 15, multiple fixing holes 142 in base 14, and multiple fixers 50. There are multiple fixed through-holes 151 on the lower part of said lodge cover 15. Fixing holes 142 are located on lower part of said base 14 and correspond to positions of fixed through-holes 151 of lodge cover 15. Said elastic tape 122 further comprises multiple anchors 1221, located on lower part of said elastic tapes 122.

Said air valve 16 connects to interior of said elastic bladder 13; the top of said base 14 connects to bottom of said elastic bladder 13; and said fixed through-holes 151 penetrate bottom of said lodge cover 15.

First, insert one end of said elastic tape 122 into breach 113 of said punching bag connecting set 11 and retains on lower part of said punching bag connecting set 11. The first block 41 of said block set 40 is installed on breach 113 of said punching bag connecting set 11, then join with second block 42 located under bottom of said punching bag connecting set 11. The first junction 112 of said punching bag connecting set 11 connects to junction section 211 of center pole 21 of one punching bag 20. The top of said elastic bladder 13 connects right under said punching bag connecting set 11.

Then, place anchors 1221 of said elastic tapes 122 on the external side of said base 14 and place lodge cover 15 on bottom of said base 14, making said anchors 1221 wedged between said lodge cover 15 and said base 14, and then fix through-holes 151 of said lodge cover 15 and fixing holes 142 in said base 14 with said fixer 50. Junction section 141 of said base 14 connects to the top of one base seat 30. Said elastic tapes 122 retains between said punching bag connecting set 11 and said base 14.

Finally, inflate said elastic bladder 13 via said air valve 16 to increase internal pressure of said elastic bladder 13. Said elastic bladder 13 only expands vertically due to existence of said restriction parts 131 which limit elastic bladder 13 for horizontal expansion. Thus, height of said elastic bladder 13 rises and enlarges the gap between said punching bag connecting set 11 and said base 14; elastic tapes 122 are simultaneously elongated to change elasticity of said elastomer 12.

Although the present invention has been explained in relation to its preferred embodiment, it is to be understood that many other possible modifications and variations can be made without departing from the scope of the invention as hereinafter claimed.

What is claimed is:

1. A punching elasticity adjustment structure, comprising one elasticity adjustment set which comprises:

one punching bag connecting set wherein one through-hole is formed at a center of said connecting set, and said connecting set further comprises one cylinder first junction; wherein one end of said first junction is inserted through said through-hole and stops at a bottom of said punching bag connecting set, and an opposite end of said first junction connects to a junction section of one punching bag;

one elastic bladder which is a vertically extendable bladder structure with its top connecting to a bottom part of said punching bag connecting set;

one air valve connecting to an interior of said elastic bladder;

one base with a top thereof connecting to a bottom of said elastic bladder, and having a junction section on a lower part thereof; and one elastomer which is elastically adjustable, positioned on a side of said elastic bladder and retained between said punching bag connecting set and said base, wherein when said elastic bladder is inflated via said air valve, and said elastomer is simultaneously elongated to adjust the elasticity of said elastomer, wherein said elastomer comprises multiple elastic tapes, wherein said elastic tapes are located on external sides of said elastic bladder, a top of said elastic tapes covers, fixed to a top of said punching bag connecting set, or integrated with said punching bag connecting set; wherein a lower part of said elastic tapes connects to said base; wherein said elastic tapes further comprises:

one through-hole, which is located on a central top of said elastic tapes and inserted through by the opposite end of said first junction section; and multiple anchors are located on a bottom of said elastic tapes.

2. A punching elasticity adjustment structure, comprising one elasticity adjustment set which comprises:

one punching bag connecting set wherein one through-hole is formed at a center of said connecting set, and said connecting set further comprises one cylinder first junction; wherein one end of said first junction is inserted through said through-hole and stops at a bottom of said punching bag connecting set, and an opposite end of said first junction connects to a junction section of one punching bag;

one elastic bladder which is a vertically extendable bladder structure with its top connecting to a bottom part of said punching bag connecting set;

one air valve connecting to an interior of said elastic bladder;

one base with a top thereof connecting to a bottom of said elastic bladder, and having a junction section on a lower part thereof; and one elastomer which is elastically adjustable, positioned on a side of said elastic bladder and retained between said punching bag connecting set and said base, wherein when said elastic bladder is inflated via said air valve, and said elastomer is simultaneously elongated to adjust the elasticity of said elastomer, wherein said elastomer comprises multiple elastic tapes, wherein said elastic tapes are located on external sides of said elastic bladder, wherein said elasticity adjustment structure further comprises:

one lodge cover, which covers a bottom of said base and has multiple fixed through-holes penetrating through a bottom of said lodge cover;

multiple fixing holes in said base, located on a bottom of said base and corresponding to positions of the fixed through-holes of said lodge cover; and multiple fixers which fix the through-holes of said lodge cover to fixing holes in said base;

wherein a top of said elastic tape covers a top of said punching bag connecting set, or is integrated with said punching bag connecting set; wherein a bottom of said elastic tapes is inserted and installed between said lodge cover and said base; wherein said elastic tapes further comprises:

one through-hole, located on a central top of said elastic tapes and inserted through by the opposite end of said first junction; and multiple anchors, located on the bottom of said elastic tape and are wedged between said lodge cover and said base.

* * * * *